US007004261B2

(12) United States Patent
Adiga

(10) Patent No.: US 7,004,261 B2
(45) Date of Patent: Feb. 28, 2006

(54) MICROEMULSION MISTS AS FIRE SUPPRESSION AGENTS

(75) Inventor: Kayyani C. Adiga, Macon, GA (US)

(73) Assignee: Nanomist Systems, LLC, Warner Robins, GA (US)

( * ) Notice: Subject to any disclaimer, the term of this patent is extended or adjusted under 35 U.S.C. 154(b) by 228 days.

(21) Appl. No.: 10/117,669

(22) Filed: Apr. 5, 2002

(65) Prior Publication Data

US 2002/0144824 A1 Oct. 10, 2002

Related U.S. Application Data

(60) Provisional application No. 60/282,013, filed on Apr. 5, 2001.

(51) Int. Cl.
*A62C 2/00* (2006.01)
*A62C 3/00* (2006.01)
*A62D 1/00* (2006.01)

(52) U.S. Cl. ..... 169/44; 169/46; 169/47; 169/DIG. 2; 252/2; 252/8.05

(58) Field of Classification Search ..... 169/44, 169/46, 47, DIG. 2; 252/3, 4, 5, 8.05, 6, 252/6.5, 186, 187, 2; 44/51, 53, 300, 301; 106/601, 603, 605; 501/83, 82, 84, 85
See application file for complete search history.

(56) References Cited

U.S. PATENT DOCUMENTS 4,049,556 A * 9/1977 Tujimoto et al. ..... 252/3
4,146,499 A * 3/1979 Rosano ..... 252/186.32
4,350,206 A * 9/1982 Hoffmann et al. ..... 169/47
4,536,298 A * 8/1985 Kamei et al. ..... 252/8.05
4,770,670 A * 9/1988 Hazbun et al. ..... 44/301
4,826,623 A * 5/1989 Bonnet et al. ..... 516/20
5,242,494 A * 9/1993 Callaghan et al. ..... 106/603

* cited by examiner

*Primary Examiner*—David A. Scherbel
*Assistant Examiner*—Darren Gorman
(74) *Attorney, Agent, or Firm*—Brian D. Bellamy

(57) ABSTRACT

A fire suppressant, fire suppressant mist, and method of atomizing a water mist for suppressing a fire are provided by in-situ atomization of water droplets within a fire using water-in-oil microemulsions. The discrete phase of emulsion is a low boiling point oil or water immiscible fluid additive combined with water and a surfactant or cosurfactant. Each dropet provides a microemulsion. During the heating of the microemulsion droplet inside the flame, the water immiscible fluid vaporizes and causes fragmentation of the water droplet, producing extremely small droplets useful in fire suppression.

7 Claims, 2 Drawing Sheets

MICROEMULSION MISTS AS FIRE SUPPRESSION AGENTS

DOMESTIC PRIORITY CLAIM

The priority of U.S. Provisional Application No. 60/282,013, filed Apr. 5, 2001 is claimed.

BACKGROUND OF THE INVENTION

1. Field of the Invention

The present invention relates to water mist fire suppression technology. More specifically, this invention relates to a method and device using microemulsions in the suppression of fire by ultrafine mist droplets.

2. Description of the Prior Art

Water mist based fire suppression systems have been in existence for many years. However, such systems were mostly replaced and the technology forgotten because of the advent of halon gas systems in the 1960's. In recent years, it has been discovered that halon gas is not environmentally safe, and its continued use has been banned due to its alleged potential to deplete ozone in the atmosphere. Thus, there is an urgent need for an alternative fire suppression system, which is effective and environmentally friendly and safe to use.

Because of several favorable properties, water mist has been reconsidered as a potential agent to replace halon gas, in particular in applications for the total flooding of machinery space or other various areas. Water is environmentally friendly with no known toxic properties. Water has a specific heat of 4.18 J/g, and a high latent heat of vaporization of 2260 J/g that assist in cooling a flame. Finally, water is readily available and cost efficient.

Water mist suppresses fire through different mechanisms. Each mechanism exhibits a different degree of influence on the overall suppression efficiency of a water mist. The four important operating mechanisms are heat extraction, oxygen displacement, radiant heat attenuation, and dilution of the vapor/air mixture. Heat extraction and cooling of the flame has the maximum effect on the efficiency of fire suppression and the other mechanisms usually supplement the heat extraction mechanism. The inventors have found that the success of water mist in its application to fire suppression depends on the ability to produce ultrafine droplets of water mist and deliver the mist to various fire scenarios. Extremely small droplets vaporize instantaneously and absorb energy to extract heat from the flame, yielding beneficial suppression properties. Water mist droplets of larger diameters vaporize more slowly and are not as efficient in suppressing fires. Further, smaller droplets increase rates of mist entrainment into the fire plume, thus increasing suppression efficiency in displacing the oxygen fueling the flame. Since heat extraction from the flame and oxygen displacement are most significant in the effectiveness of water mist systems, mechanisms that deliver very fine droplets capable of quick evaporation are desirable.

In known fine water mist fire suppression systems, a directional mist or fog of fine water droplets is generated through a nozzle. Even in the most efficient of these systems, the droplet size often ranges from 80–200 microns, and at best micromist generating technology using high-pressure nozzles appears to produce droplets on the order of 20 micron. Using mechanical high-pressure designs would require expensive and difficult to implement technology to further reduce water droplet scale. Thus, it would be desirable to reduce the droplet size of water mist produced by water mist fire suppression systems by less burdensome methods.

SUMMARY OF THE INVENTION

The present invention produces ultrafine water mist droplets in-situ inside a fire. Small globules of a suspended fluid having a lower boiling point that water are combined in a microemulsion with water external droplets, such that the microemulsion droplets comprise a fire suppression mist fluid. In particular, the microemulsions contain microdroplets of an oil fluid embedded in a continuous medium of water using a suitable surface-active agent, or a surfactant.

The physical microstructure of the microemulsion droplets provides the ability to create submicron water droplets in-situ in a fire. The microemulsion mist inside the flame undergoes microexplosive vaporization process in which the fragmentation of the external water droplets occurs if the boiling point of the oil fluid inside the water droplet is significantly lower than the water. When the oil fluid boils and begins to vaporize, the internal droplet pressure increases as a result of the vaporization of the more volatile component, or oil fluid, inside the water droplet. The internal droplet pressure fragments of water droplet into several droplets of much smaller size than the original water droplet created by a mechanical mist-generating device. The size of the ultrafine droplets may be less than a micron depending on the initial size of the mist droplets and the structure of microemulsion.

The water droplet size is reduced beyond the ability of mechanical atomization technology, providing advantages over these mechanical systems. The ultrafine droplets formed inside the flame vaporize faster producing quicker cooling and oxygen displacement and increasing the fire suppression efficiency.

DETAILED DESCRIPTION OF INVENTION

The present invention provides a method that uses a microemulsion 10 to produce an ultra-fine water mist for suppressing fires. The method provided does not reduce mist droplet size by modifying or improving existing mechanical mist production devices and nozzles. Instead, the present invention reduces the size of water mist droplet 12 downstream after it is injected into a hot flame. Therefore, the mechanism for reducing the water droplet size is independent of the mechanical features of the mist generating and delivery device.

Figure 1:
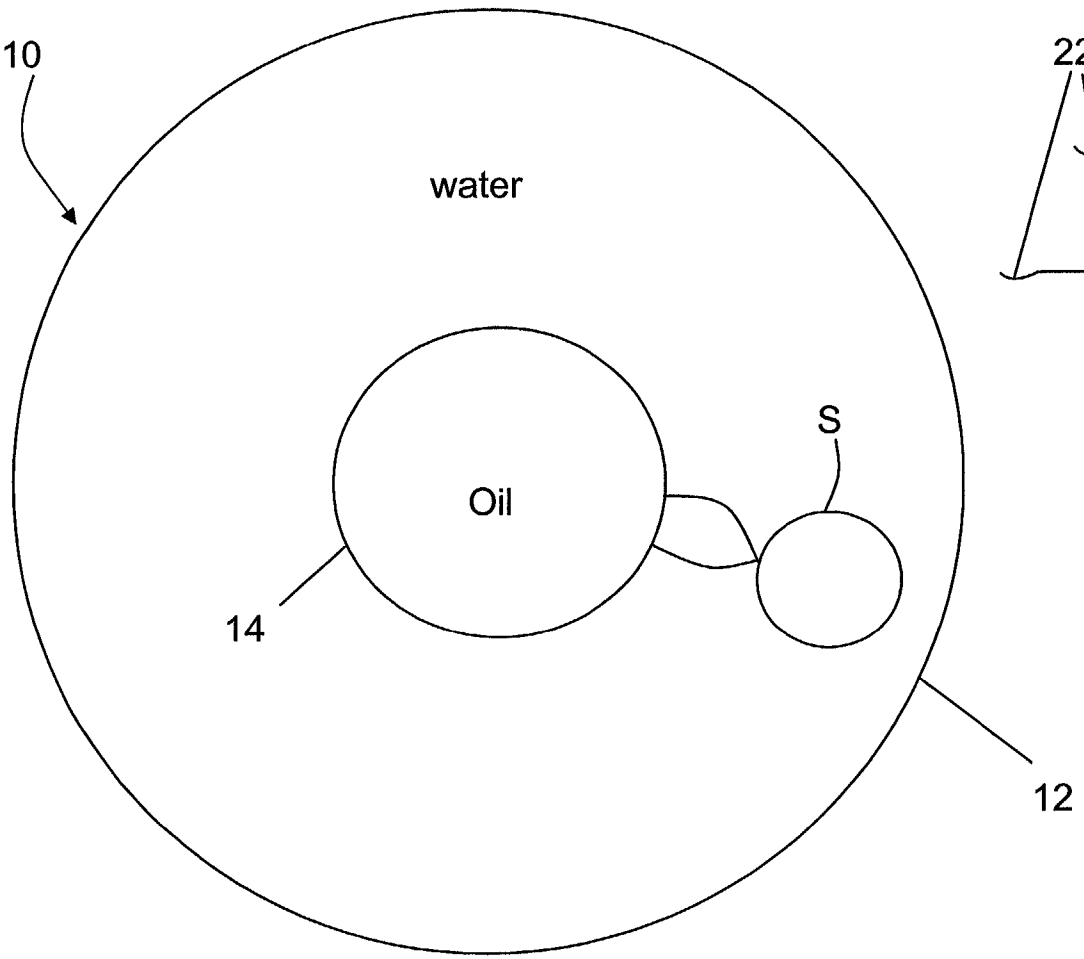
FIG. 1 is a plan view of a microemulsion droplet in accordance with an embodiment of the present invention.

As shown in FIG. 1, an oil-in-water microemulsion 10 is provided. Within each microemulsion 10, the first fluid 14 or oil is imbedded as tiny droplets within the second fluid or water droplet 12, such that the water is considered the external fluid. The oil-in-water microemulsions 10 are prepared by dissolving any desired additives in either the water fluid or oil fluid. Then, a pre-determined amount of the oil fluid and a surfactant are added to the water fluid in a tank or the like and mixed as needed, thus by stirring or by swirling using a specific tank geometry to create a desired flow for mixing.

Figure 2:
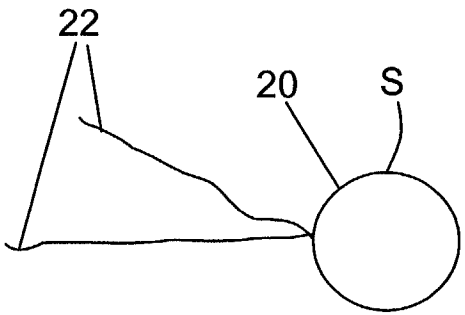
FIG. 2 is a plan view of surfactant.

Absent a surfactant, the oil and the water fluids would not generally mix well and would form two-phase fluid systems. Therefore, surfactant and cosurfactant molecules S, illustrated in FIG. 2, that have both polar 20 and non-polar 22 groups are used to hold the imbedded oil fluid 14 and the water fluid 12 together, such the polar head 20 attracts the water 12 and the non-polar tail 22 attracts the oil 14. Many surfactants (and co-surfactants) are known for creating water external microemulsions. For example, aerosol OT, petroleum sulfonates, Tween 20, Span 80 and others. Co-surfactants often involve alcohols, and inorganic salts. A combination of a suitable surfactant, and a cosurfactant is provided to develop a stable microemulsion. Preferably these surfactants and additives should be biodegradable and environmentally acceptable.

Once the first fluid and second fluid are combined, the microemulsions are indiscernible on a macroscopic scale. Thus, a macroscopically single-phase fluid that is thermodynamically stable is provided as a fire suppression fluid. The fire suppression fluid of microemulsions 10 so formed is provided to a fluid reservoir of a mist-generating device for delivery of the microemulsions 10 as mist droplets through a high-pressure nozzle or other means.

The fire suppression fluid is comprised primarily of water and a lesser percentage weight of oil. A preferable fire suppression fluid will generally comprise about ten percent or less percent weight of oil and a sufficient quantity of surfactant. In the discrete phase the oil fluid 14 may be a hexane (C6), heptane (C7), or octane (C8). Further, the imbedded fluid 14 may be any suitable combustible or non-combustible water-immiscible liquid component with a boiling point lower than water.

The water-immiscible liquid component may also be a chemical fire suppressant that will increase the suppression efficiency of the fire suppression fluid due to the synergistic effect of the water fluid and chemical suppressant. Thus, a fluid of microemulsions having a chemical fire suppressant component fluid would provide a hybrid fire suppression system.

Supplying water-soluble additives to the fire suppression fluid may also provide a hybrid fire suppression system. For example, borates, phosphates or any chemical fire suppression agent soluble in water may be added to enhance the suppression efficiency.

Figure 3:
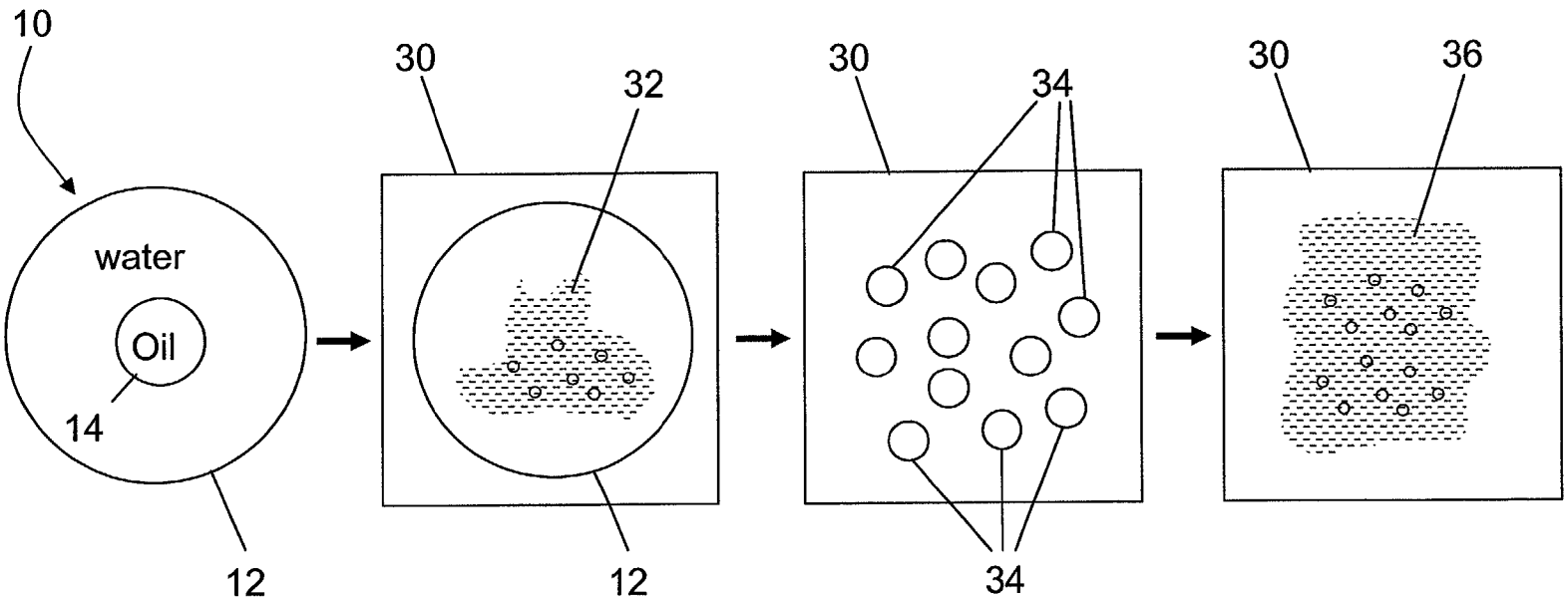
FIG. 3 is a plan view and schematic diagram of a microemulsion droplet in a hot gas environment transforming to an ultrafine water mist and subsequently vaporizing.

As illustrated by steps in FIG. 3, when the microemulsion droplets 10 are subjected to a hot gas or a fire environment 30, the droplets heat up and cause a positive atomizing event. Provided the boiling point of oil fluid 14 embedded in the water fluid droplet 12 is lower than the water fluid, the oil fluid 14 will boil and become an expanding vaporizing fluid 32 while still embedded in the water fluid droplet 12. For example, an oil fluid may boil at about 40° C., and water boils at 100° C. The gas bubbles 32 created by the boiling oil fluid 14 expand and explode the water droplet 12, causing microexplosions. The microexplosive vaporization of the oil fluid 14 produces self-accelerating atomization of the water droplets 12 in-situ inside the hot gas environment 30 or flame. The process of microexplosions within the droplets 10 causes the larger water droplet 12 created by the mist generating device to fragment and divide into many extremely small droplets 34 that are often submicron-size depending on the initial droplet size.

The droplet size created by the self-accelerating atomization process is much smaller than the initial droplet created using the existing mechanical water mist atomization process. Current methods produce mist droplets as small as 20 micron using high-pressure nozzles whereas the present process may produces mist droplets of less than one micron. The reduced droplet size increases the number of droplets per unit mass of water providing several advantages over larger and fewer droplets. The smaller droplets vaporize faster so that they produce cooling and oxygen displacement by the vaporized steam 36 in the flame more rapidly, thus putting out the fire quicker using a significantly smaller quantity of water. Additionally, the smaller droplets of submicron size help the mist behave similar to halon gas by behaving very gas-like. For instance, the gas-like water mist can reach critical areas just as halon does, and does not wet or damage items in areas such as museums, libraries, and electronic equipment and switchgear rooms. These behavioral characteristics especially distinguish the smaller droplet mist from large droplet sprinklers and the like.

I claim:

1. A method of atomizing water including the steps of:

a. Combining water with a water immiscible fluid with a boiling point lower than the water and with a surfactant or cosurfactant to form an emulsified liquid;

b. Generating a mist of microemulsion droplets from the emulsified liquid;

c. Heating the microemulsion droplets to boil the water immiscible fluid and cause the water immiscible fluid to expand and fragment the microemulsion droplets into smaller droplets of water.

2. A method of suppressing a fire including the steps of:

a. Providing an emulsion of water and a water immiscible fluid with a boiling point lower than the water, b. Atomizing the emulsion generating microemulsion droplets;

c. Delivering the microemulsion droplets to a hot gas environment;

d. Causing an expansion of the water immiscible fluid within the water; and e. Disbursing a plurality of droplets comprising water from the microemulsion droplets.

3. A method of suppressing a fire as in claim 2 in which the water immiscible fluid is a hexane, heptane, or octane.

4. A method of suppressing a fire as in claim 2 in which the water immiscible fluid is a chemical fire suppressant.

5. A method of suppressing a fire as in claim 2 in which the water immiscible fluid has a boiling point of 50° C. or less.

6. A method of suppressing a fire as in claim 2 in which the water immiscible fluid is oil.

7. A method of suppressing a fire as in claim 2 in which the microemulsion droplets have a weight comprised of 10 percent or less of the water immiscible fluid.

* * * * *